United States Patent [19]

Wendt

[11] 4,262,245

[45] Apr. 14, 1981

[54] HIGH FREQUENCY FERRORESONANT TRANSFORMER

[75] Inventor: Frank S. Wendt, Princeton, N.J.

[73] Assignee: RCA Corp., New York, N.Y.

[21] Appl. No.: 7,814

[22] Filed: Jan. 30, 1979

[51] Int. Cl.[3] ..... G05F 3/06

[52] U.S. Cl. ..... 323/308; 336/73; 336/155; 336/160; 363/75

[58] Field of Search ..... 323/6, 48, 60, 61; 336/160, 165, 170, 185, 199, 208, 211, 229; 363/75, 90

[56] References Cited

U.S. PATENT DOCUMENTS

| | | | |
|---|---|---|---|
| 787,658 | 4/1905 | Baker | 336/185 X |
| 2,014,524 | 9/1935 | Franz | 336/208 X |
| 2,388,598 | 11/1945 | Cahill | 336/208 X |
| 2,832,008 | 4/1958 | Feinberg | 336/165 X |
| 2,996,656 | 8/1961 | Sola | 323/60 X |
| 3,061,769 | 10/1962 | Smyth | 321/16 |
| 3,287,670 | 11/1966 | Schroeder | 333/79 |
| 3,293,537 | 12/1966 | Sola | 323/6 |
| 3,341,766 | 9/1967 | Rhyne | 321/9 |
| 3,351,849 | 11/1967 | Mesenhimer | 323/45 |
| 3,585,493 | 6/1971 | Moerlein | 323/61 |
| 3,605,055 | 9/1971 | Grady | 336/185 |
| 3,798,497 | 3/1974 | Manske | 315/29 |
| 3,818,314 | 6/1974 | Bishop et al. | 323/60 X |
| 3,868,538 | 2/1975 | Blanchard | 315/411 |
| 4,053,822 | 10/1977 | Tillinger et al. | 336/160 X |

*Primary Examiner*—A. D. Pellinen

*Attorney, Agent, or Firm*—Eugene M. Whitacre; Paul J. Rasmussen; Joseph J. Laks

[57] ABSTRACT

A ferroresonant transformer includes a drive winding wound around a thin strip of magnetic material and coupled to a high frequency voltage source. The drive winding is resonated with a capacitance for saturating the core portion of the strip under the drive winding. A load winding, separated from the drive winding sufficiently to provide substantial magnetic decoupling, via air, for example, is resonated with a capacitance to saturate the core portion of the strip under the load winding for providing a regulated output voltage across the load winding.

22 Claims, 6 Drawing Figures

HIGH FREQUENCY FERRORESONANT TRANSFORMER

This invention relates to high frequency ferroresonant transformers.

A ferroresonant transformer is capable of supplying regulated output voltages without use of relatively complex and costly electronic regulator circuitry. Such regulated power supplies are relatively fail-safe, as changes in the values of resonating capacitors or winding inductances will usually result in loss of ferroresonant operation.

To provide a relatively large output power of 100 watts or more at an output voltage of 100 volts or more, low frequency AC line or mains excited ferroresonant transformers are usually relatively bulky and heavy. To decrease size and weight, a ferroresonant transformer may be designed to operate at relatively high exciting source frequencies. For ferroresonant transformers used in television receiver power supplies, the source frequency may conveniently be selected as the horizontal deflection frequency of about 15.75 kilohertz.

At these high frequencies, core losses in the ferroresonant transformer, such as hysteresis and eddy current losses, may raise the core temperature to undesirable levels. The transformer structure may then require additional costly cooling structure to limit the core temperature increase.

Too large a temperature rise adversely affects output voltage regulation, as the output voltage is a function of $B_{sat}$, the saturation flux density of the core material. Because $B_{sat}$ decreases with increasing core temperature, the output voltage will undesirably decrease as the core heats up.

It is desirable therefore to design a high frequency ferroresonant transformer power supply which reduces core temperature rises and still provides relatively good output voltage regulation.

SUMMARY

A core portion under a drive winding of a ferroresonant transformer is magnetically saturated each cycle of an alternating current voltage by resonating a first capacitance with a transformer winding. A load winding is wound the core. Means are provided to magnetically decouple the two windings. A second capacitance is resonated to saturate a core portion under the load winding to regulate the output voltage across the load winding.

DESCRIPTION OF THE INVENTION

Figure 1:
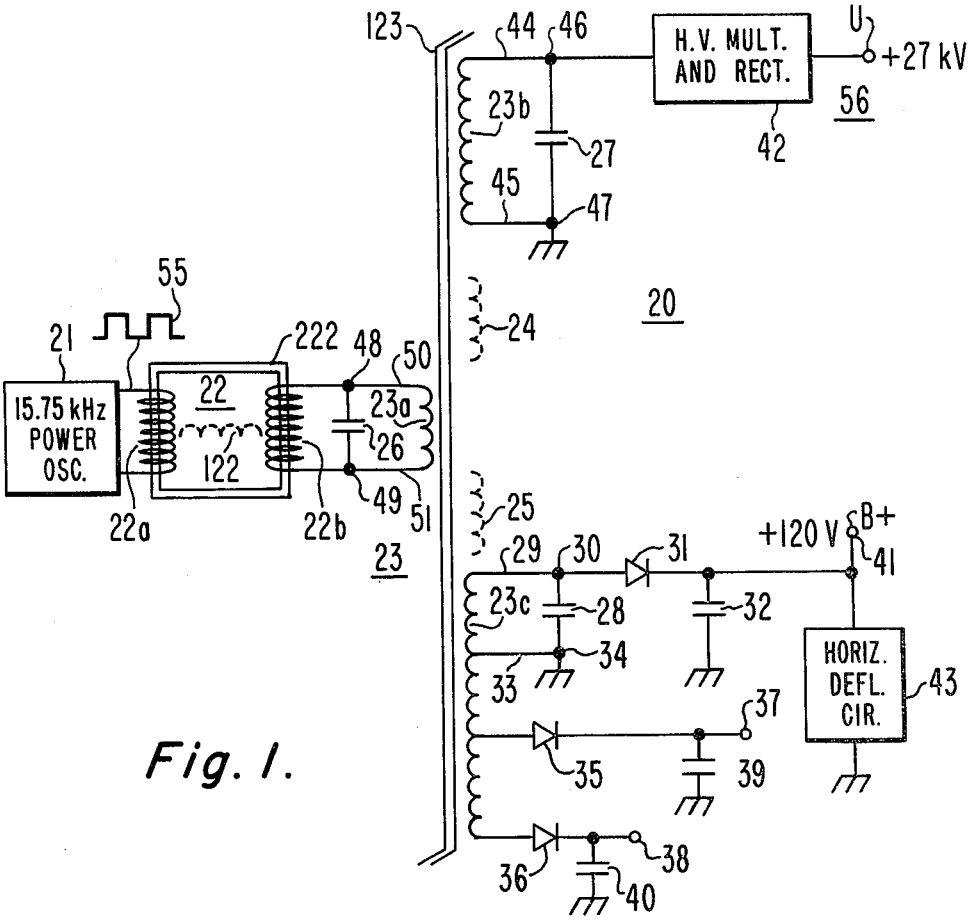
FIG. 1 illustrates a high frequency ferroresonant transformer power supply embodying the invention.

In the high frequency ferroresonant power supply 20, embodying the invention, and illustrated in FIG. 1, a conventionally designed power oscillator 21 functions as an unregulated energy source or source of an unregulated high frequency alternating current square-wave voltage 55. When power supply 20 is used to power television receiver circuits such as the horizontal deflection circuit, the audio circuit, and the ultor and kinescope drive circuits, a convenient frequency to select for high frequency alternating square-wave voltage 55 is the horizontal deflection frequency of approximately 15.75 kilohertz. A circuit which may be used as a 15.75 kilohertz power oscillator is described in copending U.S. patent application Ser. No. 007,815, filed Jan. 30, 1979, by F. S. Wendt, entitled, HIGH FREQUENCY FERRORESONANT POWER SUPPLY FOR A DEFLECTION AND HIGH VOLTAGE CIRCUIT, said application hereby incorporated by reference.

Unregulated high frequency alternating squarewave voltage 55 is coupled through a transformer 22 to a drive or excitation winding **23*a* of a high frequency ferroresonant transformer 23 embodying the invention. The primary winding 22*a* of transformer 22 is coupled to power oscillator 21 and is wound around one leg of a rectangular or closed core 222 of transformer 22. Wound around the opposite leg is secondary winding 22*b*. The lead conductors of secondary winding 22*b* are coupled to lead conductors 50 and 51 of drive winding 23*a* of high frequency ferroresonant transformer 23 at respective terminals 48 and 49**.

Drive or excitation winding **23*a* is wound around a portion of a magnetic core 123 of a high frequency ferroresonant transformer 23. Wound around another core portion of core 123 is a first load or output winding 23*b*. Wound around a still another core portion of core 123 is a second load or output winding 23*c***.

The output voltage developed across terminals 30 and 34 coupled to respective lead conductors 29 and 33 of output winding **23*c* is rectified by a diode 31 and filtered by a capacitor 32 to provide a DC voltage of +120 volts, illustratively, at a terminal 41. The DC voltage at terminal 41 functions as a B+ operating voltage for a load circuit 43. In a television receiver, the load circuit may comprise, for example, a horizontal deflection circuit. Other auxiliary power supply voltages may be obtained at terminals 37 and 38 from tap leads of output or load winding 23*c* coupled to respective rectifiers 35 and 36. Filtering is performed by respective capacitors 39 and 40**.

The output voltage developed across terminals 46 and 47 coupled to respective lead conductors 44 and 45 of output or load winding **23*b* is coupled to a load circuit 56. In a television receiver, load circuit 56 may comprise, for example, a high voltage rectifier and multiplier 42** coupled to an ultor terminal U, at which terminal a DC beam current accelerating potential of illustratively +27 kilovolts, is developed.

To enable ferroresonant transformer 23 to be of compact design and relatively low weight, the frequency of the exciting source voltage 55 coupled to drive winding **23*a* through transformer 22** is selected to be a relatively high one of 15.75 kilohertz, for example. At this frequency the core temperature rise due to such factors as hystersis and eddy current losses may cause a substantial and undesirable core temperature rise.

To reduce the core temperature rise when ferroresonant transformer 23 is excited by a high frequency voltage source, the transformer structure embodying the invention and illustrated in FIGS. 2–6 may be used. Core 123 of high frequency ferroresonant transformer 23 comprises a thin strip or slat of magnetic material, such as a square-loop ferrite, of thickness t which is relatively small compared with the width w and length l of the strip or slat. Using a thin strip, the surface area to volume ratio of core 123 is relatively large, permitting increased conductive cooling of the core, thereby substantially reducing the core temperature increase.

Figure 2:
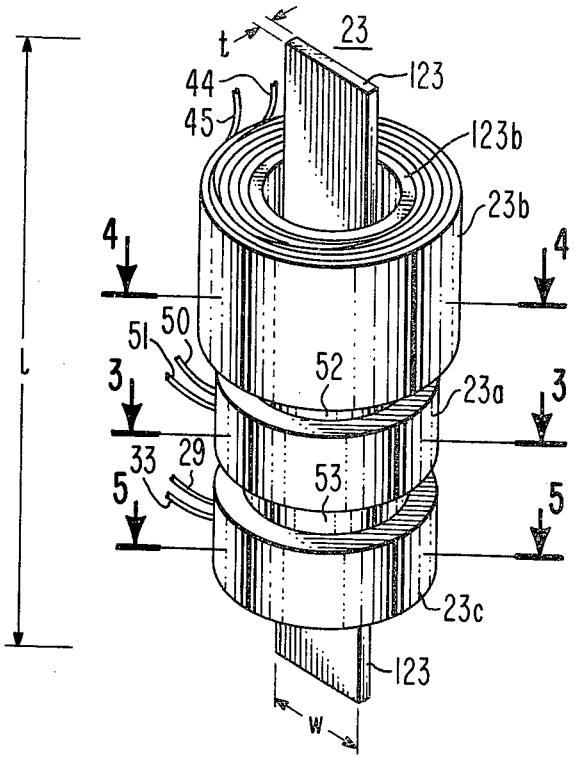
FIG. 2 illustrates a perspective view of a high frequency ferroresonant transformer structure embodying the invention.

Drive winding 23*a* and load windings 23*b* and 23*c* are coaxially wound around and longitudinally separated from one another along the thin strip 123 as illustrated in FIG. 2. As illustrated in cross-sectional view in FIG. 3 along the line 3—3 of FIG. 2, additional core cooling capability is provided by forming drive winding 23*a* into an annular coil with an inner diameter D that is relatively much larger than the thickness t of thin strip or slat 123, the inner diameter D being, illustratively, slightly greater than the width w of the thin strip. Such an arrangement permits the drive winding 23*a* to be sufficiently spaced from the core 123 to permit convective cooling by flow of a fluid such as air. Load windings 23*b* and 23*c* may also be formed as annular coils similar to drive winding 23*a*, as illustrated in FIGS. 4 and 5.

Figure 4:
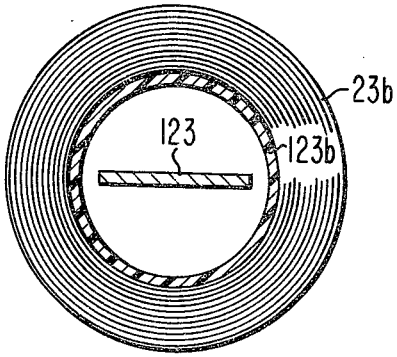
FIG. 4 illustrates a cross-sectional view of the transformer of FIG. 2 along the line 4—4.
Figure 5:
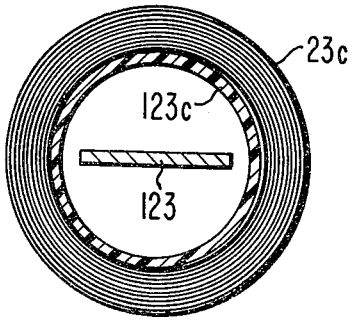
FIG. 5 illustrates a cross-sectional view of the transformer of FIG. 2 along the line 5—5.
Figure 3:
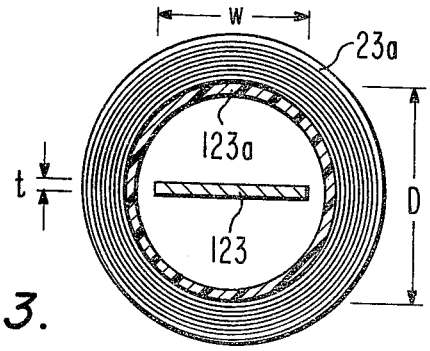
FIG. 3 illustrates a cross-sectional view of the transformer of FIG. 2 along the line 3—3.

To form drive winding 23*a* and load windings 23*b* and 23*c* into annular coils, the windings may, for example, be layer wound around respective annular coil forms 123*a*–123*c*, as illustrated in the respective cross-sectional views of FIGS. 3–5.

To provide regulated output voltages, a capacitor 27 is coupled across terminals 46 and 47 coupled to load winding 23*b* and a capacitor 28 is coupled across terminals 30 and 34 coupled to load winding 23*c*. The values of capacitors 27 and 28 are selected to tune and resonate respective load windings 23*b* and 23*c* near the frequency of the exciting source voltage 55. A resonating or circulating current, with a frequency substantially that of the source voltage 55, flows in each of the load windings. The core portion under each of the load windings magnetically saturates each half-cycle of oscillation of the circulating current flowing in each of the load windings, thereby providing a measure of regulation for the output voltages across the load windings. If a load winding such as winding 23*b* has a large number of turns, because, the winding provides a high voltage, for example, then part or all of its resonating capacitance may be formed from the interwinding stray or distributed capacitance.

The degree of regulation achieved by saturating only those core portions of ferroresonant transformer 23 that are within load or output windings 23*b* and 23*c* may not be entirely satisfactory for all purposes. Regulation is somewhat degraded because of the relatively large proportion of the total cross-sectional area within a load winding that is in air when compared with that portion of the total cross-sectional area within a winding that is comprised of thin strip magnetic core 123. That is, the ratio of air volume to magnetic core volume within the winding is very large. With the load windings loosely wound around core 123, as previously described, the transformer hysteresis loop curve of flux versus ampere-turns for transformer 23 is relatively skewed. The saturating portion of the hysteresis loop is not horizontal but tilted. Changes in the magnetic operating point of the transformer caused by variations in the amplitude of the unregulated exciting source voltage 55 will, therefore, result in greater output voltage variation than for comparable transformers with more square hysteresis loop curves.

To achieve even more load or output voltage regulation, a dual or two stage ferroresonant transformer 23 is provided. As illustrated in FIG. 1, drive or excitation winding 23*a* is coupled to a capacitor 26 for developing a circulating or resonating current in the winding of a frequency near that of source 55. This circulating current saturates the core portion of strip or slat 123 under drive winding 23*a* each half-cycle of current oscillation. Thus, the drive voltage developed across drive winding 23*a* is thereby, to a certain extent, regulated because of core saturation under the drive winding.

As illustrated in FIG. 2, drive winding 23*a* is located on strip 123 between load windings 23*b* and 23*c*. Drive winding 23*a* is separated or spaced from load winding 23*b* by a nonmagnetic annular ring spacer 52 and is separated from load winding 23*c* by a nonmagnetic annular ring spacer 53. The separation between drive winding 23*a* and each of the load windings creates magnetic leakage flux paths in the air between the drive winding and each of the load windings. Substantial amounts of magnetic flux exist that do not mutually link the drive winding and a load winding. Such magnetic leakage associated with drive winding 23*a* and load winding 23*b* is indicated in FIG. 1 by a leakage inductance 24. The magnetic leakage between drive winding 23*a* and load winding 23*c* is indicated by a leakage inductance 25.

The amount of magnetic leakage associated with ferroresonant transformer 23 is controlled by the heights of spacers 52 and 53. Sufficient magnetic leakage between drive winding 23*a* and each of the load windings 23*b* and 23*c* are required in order to substantially magnetically decouple each of the load windings from the drive winding.

With drive winding 23*a* decoupled from load windings 23*b* and 23*c*, the drive voltage developed across drive winding 23*a*, functions, in effect, as the immediate excitation source for load windings 23*b* and 23*c*. Since the drive voltage is to a certain extent already regulated because of drive winding, 23*a* being resonated with capacitor 26, the output voltage across each of the load windings is then further regulated by resonating each of the load windings with a capacitor. Because of this two-stage or dual ferroresonant transformer operation, relatively good output voltage regulation is achieved, even though relatively poor regulation may be exhibited by resonating any one of the drive winding and load winding alone.

Figure 6:
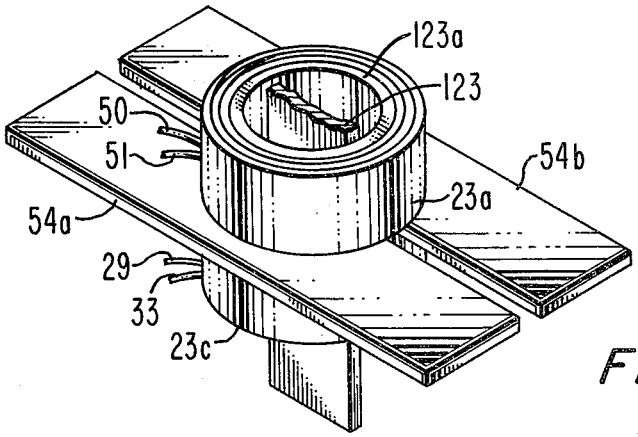
FIG. 6 illustrates in perspective view a portion of the transformer structure of FIG. 2 including a magnetic shunt separating a drive and a load winding.

Another embodiment of ferroresonant transformer 23 is illustrated in FIG. 6 by a perspective view of the transformer section of FIG. 2 adjacent drive winding 23*a* and load winding 23*c*. The transformer structure is similar to that of FIG. 2 except that drive winding 23*a* is separated from load winding 23*c*, illustratively, by magnetic shunts 54*a* and 54*b* instead of being separated by nonmagnetic spacer 53. Each of the shunts 54*a* and 54*b* illustratively comprises a strip of magnetic material placed adjacent opposite surfaces of magnetic core 123. Other magnetic shunt arrangements using magnetic materials may also be used.

Shunts 54*a* and 54*b* provide a low reluctance leakage flux path for magnetic flux originating from or linking only winding 23*a* or winding 23*c*. Shunts 54*a* and 54*b*, thus, provide for the magnetic decoupling of drive winding 23*a* and load winding 23*c* that is required for good load regulation.

Furthermore, because shunts 54*a* and 54*b* provide a low reluctance path for flux, these shunts provide relatively good magnetic shielding. The substantial amounts of flux flowing in the air portions under drive winding 23*a* are thus prevented from linking load winding 23*c*. This air flux generated by drive winding 23*a* is a function of the unregulated source voltage amplitude and therefore substantially contributes to degrading the output voltage regulation of load winding 23*c*. With shunts 54*a* and 54*b* providing a low reluctance leakage shunt path for this air flux, output voltage regulation is improved. These magnetic shunts also make for a more compact geometry than do the air spaced shunts.

Transformer 22 of FIG. 1 is designed such that its leakage inductance 122 functions as a current limiting series impedance to the current flowing from power oscillator 21 when the core portion under drive winding 23*a* becomes saturated. If power oscillator 21 is designed to be conductively coupled to high frequency ferroresonant transformer 23, transformer 22 may be replaced by a series resistor or choke coil, for example.

As illustrated in FIG. 2, the core geometry for ferroresonant transformer 23 is one providing an open magnetic path for flux linking any of the windings wound around strip core 123. That is to say, no closed magnetic paths for flux linking a winding exist that are entirely within a magnetic material.

This open strip core geometry which provides no magnetic material return path for the flux generated in the saturating portion of the core is contrary to many conventional design practices. In essence, since the air gap of this core geometry is extremely large, saturating the core should be extremely difficult. However, with the core geometry, as illustrated, this proves not to be a problem. The magnetic reluctance presented by this open strip geometry is sufficiently low for each tuned coil such that regulation is possible. In other words, the magnetic air path around each individual winding is sufficiently short to provide a sufficiently low reluctance.

This open magnetic path strip core provides a savings of core material which would otherwise be used to close the magnetic path. Also this geometry enables large diameter coils to be easily accommodated.

A typical ferroresonant transformer 23 is described below. The transformer is designed for television receiver power supply application at an input power consumption of approximately 90 to 120 watts average, at maximum video beam loading of 1.5 milliamperes DC current flowing from ultor terminal U. The ultor voltage equals approximately +27 kilovolts and the B+ voltage equals approximately +120 volts DC.

Capacitor 26 equals 0.062 microfarads;

Capacitor 28 equals 0.15 microfarads;

Capacitor 27 is replaced by the interwinding capacitance of load winding 23*b*.

Core 123: thickness t=0.075 inch; Width w=1.0 inch; length l=5.0 inch. Core material is a ferrite with $B_{sat}$ of around 4000 gauss at 25° Ferroxcube 3E2A from Ferroxcube Corp., Saugerties, N.Y. or such as RCA 540 from RCA Corp., Indianapolis, Ind.

Spacer 52 height equals 0.375 inch;

Spacer 53 height equals 0.25 inch.

Coil form 123*a* inner diameter equals 1.15 inch, outer diameter equals 1.25 inch, length equals 0.5 inch; coil from 123*b* inner diameter equals 1.15 inch, outer diameter equals 1.25 inch, length equals 1.50 inch; coil form 123*c* inner diameter equals 1.15 inch, outer diameter equals 1.25 inch, length equals 0.5 inch.

Winding 123*c*: layer wound with 25/36 nylon wrap insulated enameled copper wire, with 160 number of turns total; number of layers equals 8, number of turns per layer equals 20; length of winding equals 0.5 inch; number of turns coupled across capacitor 28 equals 58 turns.

Winding 123*b*: layer wound with number 36 gauge enameled copper wire, with 4056 number of turns total; number of layers equals 26, number of turns per layer equals 156, with 0.004 inch mylar insulation between layers, annular thickness of winding buildup equals 0.3 inch; length of winding equals 1.175 inch.

Winding 123*a*: layer wound with 25/26 nylon wrap insulated enameled copper wire, with 100 number of turns total; number of layers equals 9, number of turns per layer equals 11; annular thickness of winding buildup equals 0.4 inch; length of winding equals 0.5 inch.

What is claimed is:

1. A ferroresonant transformer power supply, comprising;

a source of alternating current voltage;

a drive winding of a ferroresonant transformer coupled to said source and wound around a magnetic core of said ferroresonant transformer;

a first capacitance resonating a winding of said ferroresonant transformer for magnetically saturating a core portion under said drive winding during each cycle of said alternating current voltage;

a first load winding wound around said magnetic core for developing a first output voltage;

first means for magnetically decoupling said drive and first load windings; and a second capacitance resonating with a winding of said ferroresonant transformer for magnetically saturating a core portion under said first load winding during each cycle of said alternating current voltage for regulating said first output voltage.

2. A ferroresonant transformer power supply, comprising:

a source of alternating current voltage;

a drive winding of a ferroresonant transformer coupled to said source and wound around a thin strip magnetic core of said ferroresonant transformer, said thin strip having a surface area-to-volume ratio sufficient to provide cooling of said magnetic core;

a first capacitance resonating a winding of said ferroresonant transformer for magnetically saturating a core portion under said drive windng during each cycle of said alternating current voltage;

a first load winding wound around said magnetic core for developing a first output voltage;

first means for magnetically decoupling said drive and first load windings; and a second capacitance resonating with a winding of said ferroresonant transformer for magnetically saturating a core portion under said first load winding during each cycle of said alternating current voltage for regulating said first output voltage.

3. A power supply according to claims 1 or 2 wherein said first means for magnetically decoupling comprises a first spacer means for separating said drive and first load windings.

4. A power supply according to claims 1 or 2 including a second load winding wound around said magnetic core for developing a second output voltage, second means for magnetically decoupling said drive and second load windings, and a third capacitance resonating with a winding of said ferroresonant transformer for magnetically saturating a core portion under said second load winding during each cycle of said alternating current voltage for regulating said second output voltage.

5. A power supply according to claim 4 wherein said second means for magnetically decoupling comprises a second spacer means for separating said drive and second load windings.

6. A power supply according to claim 4 wherein said drive, first and second load windings are coaxially wound around and longitudinally separated from one another along said magnetic core, with said drive winding being located between said first and second load windings, each of said first and second load windings being coupled to a current drawing load in addition to being coupled to the respective one of said second and third capacitances.

7. A power supply according to claim 2 wherein at least one of said drive and first load windings is spaced from said thin strip sufficient to permit convective fluid flow between said one winding and said thin strip.

8. A power supply according to claims 1 or 2 including a magnetic material separating said drive and first winding for providing a low reluctance path for leakage magnetic flux.

9. A ferroresonant transformer structure for providing a regulated output voltage and a reduced magnetic core temperature increase, comprising:

a thin slat of magnetic material;

an excitation winding wound around said thin slat and suitable for coupling to a source of alternating current voltage;

a first capacitance for resonating with a winding of said transformer for magnetically saturating a portion of said thin slat under said excitation winding;

a first output winding wound around said thin slat, said first output winding separated from said excitation winding to create a shunt magnetic flux path for providing a substantial amount of magnetic decoupling between said excitation and first output windings; and a second capacitance for resonating with a winding of said transformer for magnetically saturating a portion of said thin slat under said first output winding for providing a regulated first output voltage.

10. A transformer according to claim 9 wherein the surface area-to-volume ratio of said thin slat is sufficiently great to provide cooling of said thin slat.

11. A transformer according to claim 10 wherein at least one of said excitation and first output windings is formed into an annular coil with an inner diameter that is sufficiently larger than the thickness of said thin slat to enable convective cooling of said thin slat.

12. A transformer according to claim 11 wherein said excitation and first output windings are separated by a magnetic material which functions as a low reluctance shunt magnetic flux path.

13. A transformer according to claims 9, 10, 11, or 12 including a second output winding wound around said thin slat, said second output winding separated from said excitation winding to create a shunt magnetic flux path for providing a substantial amount of magnetic decoupling between said excitation and second output windings, and a third capacitance for resonating with a winding of said transformer for magnetically saturating a portion of said thin slat under said second output winding for providing a regulated second output voltage.

14. A transformer according to claim 13 wherein said excitation winding is located on said thin slat between said first and second output windings.

15. A ferroresonant transformer having a plurality of windings and a magnetizable core and capable of operation at high frequencies without a substantial increase in the temperature of said core, said transformer comprising:

a magnetizable core including a thin strip portion of thickness small relative to the strip portion width to provide a substantial strip surface area-to-volume ratio;

a first of said plurality of windings being wound around said magnetizable core and adapted for coupling to a source of high frequency unregulated alternating current voltage;

a second of said plurality of windings developing an output voltage, said second winding being loosely wound lengthwise around said thin strip portion such that the amount of thin strip portion located interior to said second winding is substantially less than the space encompassed by said second winding so as to permit cooling of said thin strip portion;

a capacitance coupled to one of said plurality of windings and resonating with said one winding to magnetically saturate a portion of said magnetizable core for regulating the output voltage developed across said second winding.

16. A ferroresonant transformer according to claim 15 wherein the interior space encompassed by said second winding other than the space taken up by said thin strip portion is substantially filled by a heat conducting fluid to provide convective cooling.

17. A ferroresonant transformer according to claims 15 or 16 wherein said first winding is wound adjacent said second winding lengthwise around said thin strip portion and including another capacitance coupled to a given winding of said plurality of windings other than said one winding and resonating with said given winding to magnetically saturate said thin strip portion under said first winding.

18. A ferroresonant transformer power supply, comprising:

a source of alternating current voltage;

an impedance;

a ferroresonant transformer with a magnetizable core and a plurality of windings including a drive winding wound around a portion of said magnetizable core, said drive winding being coupled in series with said impedance across said source;

a first capacitance resonating one of said plurality of windings for magnetically saturating during each cycle of said alternating current voltage a portion of said magnetizable core associated with said drive winding;

a first load winding wound around a portion of said magnetizable core for developing a first output voltage; and a second capacitance resonating one of said plurality of windings for magnetically saturating during each cycle of said alternating current voltage a portion of said magnetizable core associated with said first load winding to regulate said first output voltage.

19. A power supply according to claim 18 wherein said impedance comprises an inductance for limiting the current in said drive winding that flows from said source when said magnetizable core portion associated with said drive winding is magnetically saturated.

20. A power supply according to claim 19 including a second load winding wound around a portion of said magnetizable core for developing a second output voltage and including a third capacitance resonating one of said plurality of windings for magnetically saturating during each cycle of said alternating current voltage a portion of said magnetizable core associated with said second load winding to regulate said second output voltage.

21. A power supply according to claim 20 wherein said magnetizable core comprises a thin strip, said drive, first and second load windings being coaxially wound and longitudinally separated from one another along said thin strip, with said drive winding being located between said first and second load windings.

22. A power supply according to claim 19 wherein said magnetizable core comprises a thin strip, the thickness of said thin strip being small relative to the strip width to provide a substantial surface area-to-volume ratio and wherein the volume of thin strip material located interior to said drive and first load windings is substantially less than the volume of space encompassed by said drive and first load windings so as to permit cooling of said thin strip.

* * * * *